United States Patent [19]

Mitadera et al.

[11] Patent Number: 4,470,389

[45] Date of Patent: Sep. 11, 1984

[54] BREATHER-LUBRICATOR SYSTEM FOR ENGINES

[75] Inventors: Takashi Mitadera, Akashi; Tetsuaki Shirai, Kobe; Fumikazu Miyanaga, Kakogawa, all of Japan

[73] Assignee: Kawasaki Jukogyo Kabushiki Kaisha, Kobe, Japan

[21] Appl. No.: 463,843

[22] Filed: Feb. 4, 1983

[30] Foreign Application Priority Data

Feb. 8, 1982 [JP] Japan ..... 57-19085
Feb. 8, 1982 [JP] Japan ..... 57-19086

[51] Int. Cl.[3] ..... F01M 13/04
[52] U.S. Cl. ..... 123/196 CP; 123/41.86
[58] Field of Search ..... 123/41.86, 195 R, 196 CP, 123/196 W, 196 R; 184/6.1 E, 6.21; 92/79

[56] References Cited

U.S. PATENT DOCUMENTS 1,921,175 8/1933 Towler ..... 123/41.86
2,539,896 1/1951 Dalrymple ..... 92/79
2,669,322 2/1954 Brown ..... 123/195 R
2,693,791 11/1954 Lechtenberg ..... 123/195 R
3,456,759 7/1969 Henry-Biabaud ..... 123/41.86
3,523,592 8/1970 Fenton ..... 123/196 R

*Primary Examiner*—William A. Cuchlinski, Jr.
*Attorney, Agent, or Firm*—Marshall, O'Toole, Gerstein, Murray & Bicknell

[57] ABSTRACT

This disclosure relates to a combined breather-lubricator system for an internal combustion engine having a horizontal cylinder, a crankcase, a vertical crankshaft journalled by an upper and a lower bearings in the crankcase, and a valve spring chamber in the crankcase.

The system includes two breather passages. The first breather passage extends from the crankcase through a check valve and the spring chamber and opening into the atmosphere, the valve being adapted to pass fluid therethrough in the direction from the crankcase to the atmosphere. The second breather passage extends back from the atmosphere through an oil drain hole in the spring chamber into the crankcase.

The system further includes a lubrication system connected to the first breather passage.

4 Claims, 4 Drawing Figures

BREATHER-LUBRICATOR SYSTEM FOR ENGINES

This invention relates to a combined breather-lubricator system for internal combustion engines, and more particularly for single cylinder, air cooled, four-stroke cycle horizontal engines. Such an engine has a horizontally disposed cylinder, a vertically disposed crankshaft, and a crankcase with an oil pan connected to the bottom thereof.

An engine of this sort needs a breather for ventilating the crankcase. In the meantime, it is required that the breather minimize the emission of oil through the vent-holes.

A conventional breather is shown in Lechtenberg U.S. Pat. No. 2,693,791 of Nov. 9, 1954, wherein an oil passage extends from the crankcase to the valve spring compartment and back into the crankcase through a drain port, while an air passage extends from the crankcase through a tortuous passage and a check valve for maintaining a partial vacuum in these chambers to the atmosphere.

Such a breather of a horizontal engine has a problem, when the engine is operated at an angle, e.g. in the order of 30°, that the valve spring compartment may contain oil up to the oil level in the oil pan, and the oil may not return to the crankcase by the action of gravity, but may be splashed by the action of the valve spring outwardly through the breather hole.

On the other hand, an oil slinger associated with the crankshaft splashes the oil in the pan to lubricate the parts in the crankcase. In this respect, reference may be made to Brown U.S. Pat. No. 2,669,322 of Feb. 16, 1954 and Ebert U.S. Pat. No. 3,144,097 of Aug. 11, 1964.

In the prior art horizontal engine constructions, the upper bearing for the crankshaft is positioned high and remote from the lubricant well on the pan. Particularly when the engine is operated in an oblique or moving condition, so that the oil level is not in the normal position, the oil is not accurately slung, resulting in poor lubrication of the upper bearing.

It is a general object of this invention to provide an improved, combined breather-lubricator system for such engines, including means to prevent oil flow from the crankcase into the valve spring chamber even when the engine is operated in an oblique condition, and means to lubricate the upper crankshaft bearing by utilizing the oil-air mist moving to the breather.

A preferred embodiment of the invention will be explained below with reference to the accompanying drawings, wherein.

Figure 1:
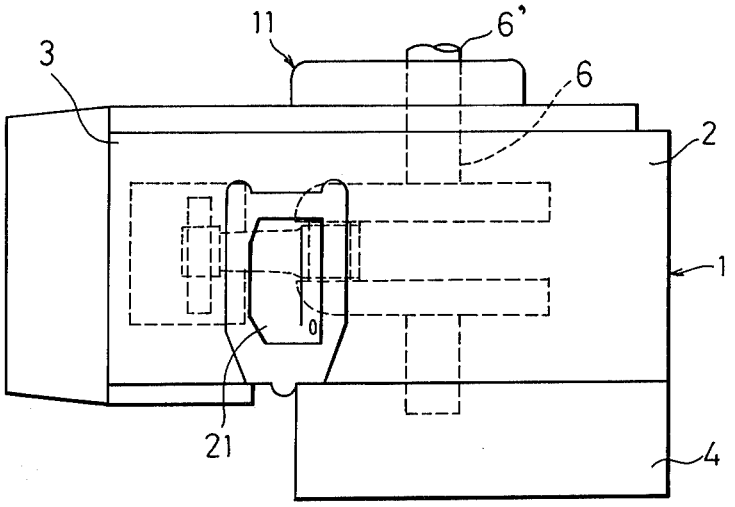
FIG. 1 is a schematic side view of the main parts of a horizontal engine.
Figure 3:
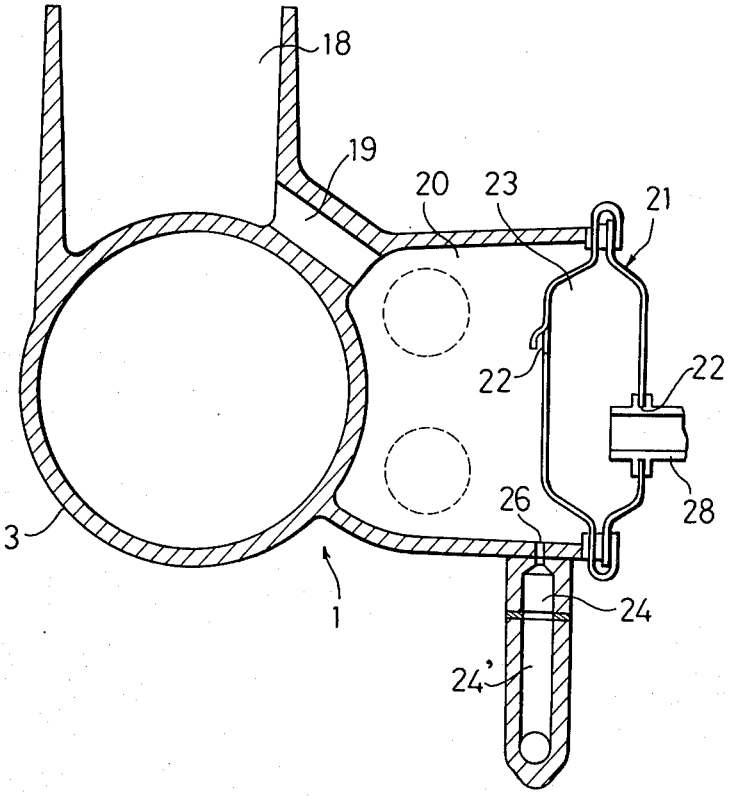
FIG. 3 is a cross section on line III—III in FIG. 2.

With reference to the drawings, the engine has a main block 1 forming the engine casing and including a crankcase section 2 and a horizontal cylinder section 3, which are integrally die-casted of aluminum alloy. Connected to the underside of crankcase section 2 is a die-casted oil pan block 4, forming a closed crankcase 5.

A crankshaft 6 on a vertical axis is journalled by an upper bearing 7 (FIG. 2) of main block 1, and by a lower bearing (not shown) of oil pan block 4. A conventional oil slinger (not shown) located in the crankcase 5 and driven by the crankshaft 6, splashes the lubricant collected on the pan 4 and creates an oil mist to lubricate the engine parts in the interior of crankcase 5. The upper bearing 7 is lubricated by the splashed oil and the mist passing through a hole 8 in the crankcase section.

The crankcase section 2 is closed by an upper cover 11 air-tightly with a gasket 11'. The cover 11 has a sleeve section 9 and a compartment 10 beside the sleeve 9. The sleeve 9 tightly engages inside a socket 5' of the crankcase section above the upper bearing 7. The crankshaft 6 has an upper extension 6' surrounded by the sleeve 9, forming an annular space 12 therebetween, which is sealed by a ring 13 at the upper end of sleeve section 9. The crankshaft 6 has an outer protruding end, to which a flywheel 14 is secured.

The compartment 10 communicates with the annular space 12 through a hole 15 in the sleeve section 9 and in turn with the crankcase 5 through the hole 8. The compartment 10 is partitioned at its bottom from a lower chamber 18 of the crankcase section by a partition 17 having a check valve 16. The valve 16 can be opened by fluid flowing out of the compartment 10 through the valve. The lower chamber 18 communicates through a venthole 19 with a valve spring chamber 20 of the crankcase section.

The spring chamber 20 is covered by a double-walled cover 21 secured to a junction face 27 of chamber 20, but is open to the atmosphere through holes 22 in the cover 21 so that the spring chamber is at atmospheric pressure. The cover 21 forms a separate chamber 23, which may contain filter material (not shown). The hole 22 in the outer wall of cover 21 may be provided with a breather tube 28 therethrough.

Figure 2:
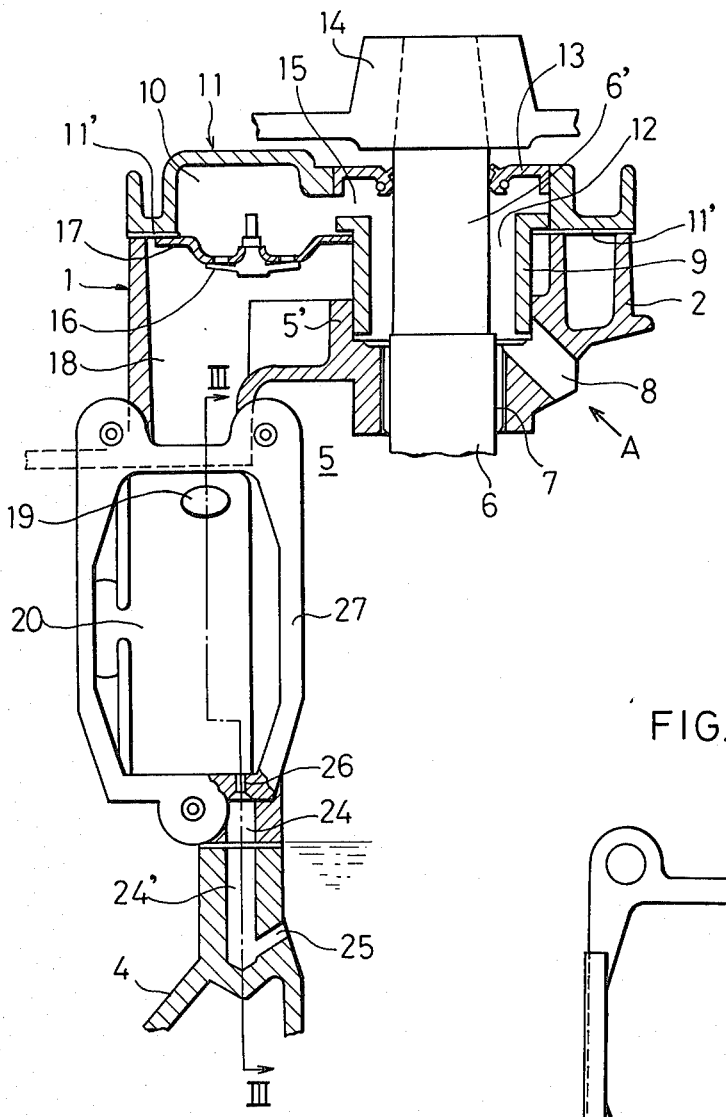
FIG. 2 is a fragmentary side view partially in longitudinal section of such parts on an enlarged scale.
Figure 4:
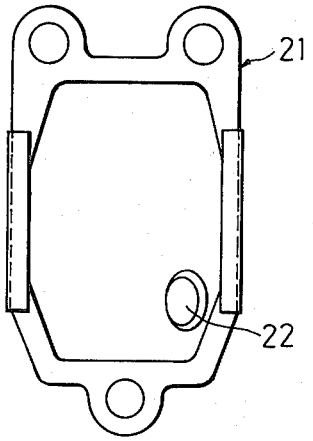
FIG. 4 is an elevational view of the cover of the valve spring chamber of such an engine.

The spring chamber 20 has an oil drain hole 24 formed in its bottom and having an inlet port 26 open to the chamber 20. The hole 24 communicates with another drain hole 24' in the junction face of oil pan block 4 (FIG. 2). The hole 24' has an outlet port 25 open into the pan 4 under the oil level, so that no air may pass from the crankcase 5 through the port 25, holes 24', 24, port 26 and spring chamber 20 into the atmosphere.

Thus, a breather system is provided having two passages. One of the passages extends from the crankcase 5 through the annular space 12, check valve 16 and spring chamber 20 and breather to the atmosphere. The other passage extends back from the atmosphere through the spring chamber 20 and drain hole 24 into the crankcase 5. The check valve 16 has a spring constant such that it can open when the piston-produced pressure in the compartment 10 is higher than the pressure in the portion of breather passage between the valve 16 and hole 22, which is equivalent to the atmospheric pressure.

When the piston stroke tends to compress the air in the crankcase 5, the valve 16 opens, allowing an air flow containing an oil mist from the crankcase through the breather passage in the direction shown by the arrow A in FIG. 2. When the piston stroke produces a vacuum in the crankcase 5, the valve 16 closes. Thus the arrangement tends to produce a partial vacuum in the crankcase. The oil contained in the spring chamber 20 by the reason mentioned above, will then return through the hole 24 to the pan 4 of the crankcase mainly by the pressure difference between the atmospheric pressure in the spring chamber 20 and the vaccuum in the crankcase 5.

The oil mist carried through the hole 8 into the annular space 12 strikes and sticks to the crankshaft extension 6', and the inner wall of sleeve 9, and the resultant oil drops fall to lubricate the upper bearing 7.

The inlet 26 of hole 24 should have a diameter smaller than the other holes in the oil drain system. This serves to maintain a sufficient pressure difference to return the oil to the pan. This, and the fact that the lower end of the hole 24 is below the oil level in the pan 4, also prevent the oil from reversely flowing through the hole 24 into the spring chamber 20, such as due to turbulence of the oil level in the pan 4 which is caused by the oil slinger.

The sleeve 9 may otherwise be constructed integrally with the crankcase 5.

The other engine parts that are not shown or described in detail, such as the valves and springs in the chamber 20, the oil slinger, the piston and connecting rod, etc. may all have a conventional construction.

We claim:

1. A combined breather-lubricator system for an internal combustion engine having a horizontal cylinder, a crankcase, a vertical crankshaft journalled by an upper bearing and a lower brearing in said crankcase, and a valve spring chamber in said crankcase, said valve spring chamber having a breather opening to the atmosphere, said system comprising an annular space formed around said crankshaft above said upper bearing and connected to said crankcase, a check valve, a first breather passage extending from said crankcase successively through said annular space, said check valve and said spring chamber and opening through said breather opening into the atmosphere, said valve being adapted to pass fluid therethrough in the direction from said crankcase to the atmosphere, a second breather passage extending back from the atmosphere through said breather opening, said spring chamber, an oil drain passage in said spring chamber into said crankcase, and a lubrication system connected to said first breather passage upstream from said check valve so as to direct fluid with an oil mist produced in said crankcase into said annular space and adjacent said upper bearing.

2. A breather-lubricator system according to claim 1, wherein said oil drain passage opens into said crankcase under the oil level.

3. A breather-lubricator system according to claim 1, wherein said oil drain passage has an inlet port of smaller diameter than the other portion of said drain passage.

4. A combined breather-lubricator system for an internal combustion engine having a horizontal cylinder, a crankcase, a vertical crankshaft journalled by an upper bearing and a lower bearing in said crankcase, said system comprising a space formed around said crankshaft above said upper bearing and connected to said crankcase, a check valve, said crankcase having a breather opening formed therein leading to the atmosphere, and a breather passage extending between said crankcase and through said space, then through said check valve, and then through said breather opening to the atmosphere, whereby a lubricant separated in said space from an air flow through said passage can lubricate said upper bearing.

* * * * *